US010495369B2

(12) United States Patent
Coemert et al.

(10) Patent No.: US 10,495,369 B2
(45) Date of Patent: Dec. 3, 2019

(54) REFRIGERATION DEVICE COMPRISING A FAN WITH AN HEAT-CONDUCTING ELEMENT

(71) Applicant: BSH HAUSGERAETE GMBH, Munich (DE)

(72) Inventors: Mesut Faruk Coemert, Istanbul (TR); Samet Keskin, Istanbul (TR); Ahmet Saygi, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 287 days.

(21) Appl. No.: 15/367,499

(22) Filed: Dec. 2, 2016

(65) Prior Publication Data

US 2018/0156522 A1 Jun. 7, 2018

(51) Int. Cl.

| | |
|---|---|
| ***F25D 21/08*** | (2006.01) |
| ***F25D 17/06*** | (2006.01) |
| ***F25D 11/00*** | (2006.01) |
| ***F25D 23/00*** | (2006.01) |

(52) U.S. Cl.

CPC ..... *F25D 21/08* (2013.01); *F25D 11/00* (2013.01); *F25D 17/062* (2013.01); *F25D 23/006* (2013.01)

(58) Field of Classification Search

CPC ..... F25D 21/08; F28F 17/00

See application file for complete search history.

(56) References Cited

U.S. PATENT DOCUMENTS

| | | | | |
|---|---|---|---|---|
| 4,740,670 | A * | 4/1988 | You | F24H 3/0417 165/181 |
| 7,218,847 | B2 * | 5/2007 | Mizukawa | H01L 21/67103 219/521 |
| 2005/0173096 | A1 * | 8/2005 | Hsu | F28D 15/0233 165/104.21 |
| 2014/0056578 | A1 * | 2/2014 | Rodbro | F04D 25/088 392/362 |
| 2017/0321951 | A1 * | 11/2017 | Jackmann | F25D 21/08 |

FOREIGN PATENT DOCUMENTS

| | | |
|---|---|---|
| EP | 1783445 A1 | 5/2007 |

* cited by examiner

*Primary Examiner* — Filip Zec

(74) *Attorney, Agent, or Firm* — Laurence A. Greenberg; Werner H. Stemer; Ralph E. Locher

(57) ABSTRACT

A refrigeration device has a refrigerant circuit for cooling a cooling chamber. An air channel conducts air to the cooling chamber. A fan is positioned in an evaporator area and supplies air from the evaporator area through the air channel to the cooling chamber; an evaporator of the refrigerant circuit cools air during a cooling cycle. The evaporator is positioned in front of the fan in relation to the direction of flow. An heating element is positioned in the evaporator area and heats the evaporator during a defrost cycle to melt surface ice accumulated on the evaporator. The heating element heats the evaporator and a first area of the fan during the defrost cycle. The fan has a heat-conducting element extending from the first area to a second area, and transfers heat from the first to the second area to melt surface ice accumulated thereon during the defrost cycle.

14 Claims, 3 Drawing Sheets

REFRIGERATION DEVICE COMPRISING A FAN WITH AN HEAT-CONDUCTING ELEMENT

BACKGROUND OF THE INVENTION

Field of the Invention

The present disclosure relates to a heat-conducting element of a fan in a refrigeration device.

A refrigeration device can be used to store a variety of goods in a cooling chamber at reduced temperature. The refrigeration device includes a refrigerant circuit, which inter alia comprises an evaporator, which in turn is configured to function as a cooler to cool surrounding air. A fan is positioned in the refrigeration device to supply the cold air to the cooling chamber.

Due to humidity in the air, ice can accumulate on the evaporator and on the fan during a cooling cycle of the refrigeration device. Increasing amounts of surface ice can impair the function of the evaporator and the fan. Therefore, to remove surface ice from said components, an heating element can be activated during a defrost cycle of the refrigeration device. The heating element emits heat, which is transferred to the evaporator and the fan to melt surface ice accumulated on said components. However, due to the limited heating power of the heating element of the evaporator and due to the substantial distance between the evaporator and the fan, certain areas of the fan may not be sufficiently heated to completely remove the surface ice on the fan.

In EP 1 783 445 A1, a refrigeration device is disclosed, which comprises a fan and a heater for defrosting, which in turn is mounted on a heating plate. The heating plate is in physical contact with both the evaporator and the fan to transfer heat from the heater to the evaporator and the fan.

SUMMARY OF THE INVENTION

It is therefore an object of the present disclosure to provide a concept for transferring heat to areas of the fan, which are not sufficiently heated by a heating element of a refrigeration device.

This object is achieved by way of the features of the independent patent claim. Advantageous developments are the subject matter of the dependent claims, the description and the appended figures.

The present disclosure is based on the finding that the above object can be achieved by a heat conducting element of the fan, which is able to conduct heat from a first area of the fan, which is indirectly heated by an heating element of the evaporator, to a second area of the fan, which is not sufficiently heated by the heating element. Therefore, by said heat transfer, the temperature of the second area of the fan could be significantly increased above 0° C. by transferring heat from the first area of the fan. Consequently, the heat transfer enables a complete melting of ice in both respective areas of the fan without the necessity to use an additional heater in the fan.

According to an aspect, the present disclosure relates to a refrigeration device having a refrigerant circuit for cooling a cooling chamber of the refrigeration device, comprising an air channel for conducting air to the cooling chamber; a fan, which is positioned in an evaporator area of the refrigeration device, and which is configured to supply air from the evaporator area through the air channel to the cooling chamber in a direction of flow; an evaporator of the refrigerant circuit configured to cool air during a cooling cycle, wherein the evaporator is positioned in the evaporator area in front of the fan in relation to the direction of flow; and an heating element, which is positioned in the evaporator area and is configured to heat the evaporator during a defrost cycle to melt surface ice accumulated on the evaporator; wherein the fan comprises a first area facing towards the evaporator and a second area facing away from the evaporator, wherein the heating element is configured to heat the evaporator and the first area of the fan during the defrost cycle, and wherein the fan comprises a heat-conducting element, which extends from the first area to the second area of the fan, and which is configured to transfer heat from the first area to the second area to melt surface ice accumulated on the second area during the defrost cycle.

As a result of the heat-transfer from the first area to the second area of the fan by the heat-conducting element, both the first and second area of the fan can be sufficiently heated to completely remove surface ice on the fan during the defrost cycle.

Upon activation of the heating element during the defrost cycle, ice on the evaporator is melted relatively fast due to the direct contact between the heating element and the evaporator. During the defrost cycle the fan is typically deactivated. Due to the substantial distance between the evaporator and the fan, the heated air has to diffuse from the heating element through the evaporator to the fan. Therefore, when reaching the fan, the heated air is typically warm enough to melt ice at the first area facing towards the evaporator, but is typically not warm enough to heat the second area, which is facing away from the evaporator. Therefore, without any heat conduction within the fan, the temperature of the second area of the fan will not be above 0° C., thereby preventing a complete melting of surface ice in the second area of the fan.

However, according to the present disclosure, the heat-conducting element located at the fan thermally connects the first area and the second area of the fan. During the defrost cycle, the heat-conducting element conducts excess heat from the first area to the second area, thereby sufficiently warming the second area of the fan to melt surface ice accumulated on the second area.

According to one example, the fan comprises a fan motor housing with a bottom side facing away from the evaporator, wherein the heat-conducting element is positioned at the bottom side, and wherein the heat-conducting element is in thermally conductive contact with the first and second area. As a result, a sufficient heat transfer from the first to the second area is achieved by the heat-conducting element. The fan motor housing may comprise a thermally conductive material, i.e. a thermally conductive metal. Therefore, despite positioned at the bottom side, which is facing away from the evaporator, the heat-conducting element is in thermally conductive contact with the first area, which in turn is facing towards the evaporator, to allow for a sufficient heat transfer from the first area to the second area of the fan.

According to one example, the fan comprises a fan cover with a top side facing towards the evaporator, wherein the heat-conducting element is positioned at the top side, and wherein the heat-conducting element is in thermally conductive contact with the first and second area.

As a result, a sufficient heat transfer from the first to the second area is achieved by the heat-conducting element. Therefore, the heat-conducting element, which is positioned at the top surface facing towards the evaporator, is in thermally conductive contact with the first and second area of the fan, and allows for a sufficient heat transfer from the first area to the second area.

According to one example, the heat-conducting element comprises a heat-absorbing area, which is in thermally conductive contact with the first area of the fan, and wherein the heat-conducting element comprises a heat-emitting area, which is in thermally conductive contact with the second area of the fan.

As a result, the heat-conducting element is divided into two areas. Heat absorbed from the first area of the fan by the heat absorbing area of the heat-conducting element is transferred through the heat-conducting element to the heat-emitting area of the heat-conducting element, from which the heat is transferred to the second area of the fan.

According to one example, the fan comprises a fan channel comprising a fan inlet and a fan outlet, wherein air is introduced into the fan inlet, is transferred through the fan channel and is released into the air channel through the fan outlet, wherein the first area of the fan is in thermally conductive contact with the fan inlet.

As a result, during the cooling cycle of the refrigeration device, the fan channel allows for an efficient transfer of cold air through the fan, and through the air channel into the cooling chamber. During the defrost cycle, heated air entering the fan inlet increases the temperature of the first area of the fan due to thermal conduction. The heat is transferred from the first area to the second area by the heat-conductive element.

According to one example, the fan comprises a fan motor housing configured to enclose a fan motor, and wherein the fan comprises a fan cover configured to enclose the fan channel, wherein the fan channel is positioned between the fan motor housing and the fan cover. As a result, the channel is properly enclosed by the fan motor housing and the fan cover. During the cooling cycle of the refrigeration device, cold air could be efficiently transferred through the fan channel.

According to one example, the fan inlet comprises an annular inlet opening, and/or wherein the fan outlet comprises a rectangular outlet opening. As a result, a sufficient air transfer through the fan channel is ensured.

According to one example, the heat-conducting element comprises metal, in particular aluminum or steel. As a result, efficient heat conduction is achieved by the heat-conducting element.

The heat-conducting element may be implemented integrally. For example, "implemented integrally" could in particular mean made of one piece. "Made of one piece" is, in particular, to mean, in this context, manufactured from one single piece, e.g. by production from one single cast and/or by manufacturing in a one-component or multi-component injection-molding process, or from a single blank. The heat conducting element may alternatively be implemented by at least two or multiple heat conducting sub-elements. The sub-elements may be connected to each other, in particular such that they are configured to transfer heat between each other. For example they may contact each other. The sub-elements may be identical elements.

According to one example, the heat-conducting element is formed as a ring or as a rectangular sheet. The ring may be implemented integrally or may be made of at least two ring segments, in particular identical ring segments. As a result, the shape of the heat-conducting element can be properly adapted with respect to the geometry of the fan.

The heat-conducting element may be made of solid material. The heat-conducting element may be a thin-walled element. In particular a thickness of the heat-conducting element may at least five times smaller or at least ten times smaller or at least twenty times smaller than a largest extension of the heat-conducting element. The heat-conducting element may be a stamp-bent-piece. In this way a simple to produce and yet effective heat-conducting element is obtainable.

The heat-conducting element may be fixed to the fan by a form-fit and/or a force-fit. By the term "fixed in a force-fit and/or form-fit manner" is in particular to be understood releasably connected, wherein a holding force between two structural components is transferred via a geometric engagement of the structural components with each other, and/or via a friction force acting between the structural components. Alternatively or additionally a fixation may be provided by a substance-to-substance bond, an adhesive and/or cohesive connection. The heat-conducting element may be fixed to the fan using double-sided adhesive tape. The heat-conducting element may be fixed to the fan using a thermally conductive adhesive material.

The heat-conducting element may be fixed to a fan cover of the fan. In particular the heat-conducting element may be fixed to a fan motor housing. In particular the heat-conducting element may be fixed to an outer surface of the fan cover and/or the fan motor housing. In this way the heat-conducting element may be fixed to a fan during the assembly of the refrigeration device whereas the very same fan may be used without the heat-conducting element in a different type of refrigeration device leading to reduced production costs.

The heat-conducting element may be configured only to transfer heat from the first area to the second area to melt surface ice accumulated on the second area during the defrost cycle. In particular the heat-conducting element may not be configured to serve any other purpose than to transfer heat from the first area to the second area to melt surface ice accumulated on the second area during the defrost cycle. In particular the heat transfer element may not be configured to join two separate elements of the refrigeration device or to attach two separate elements of the refrigeration device to each other.

According to one example, the heating element is formed as a metal sheet and is positioned at a bottom side of the evaporator area. As a result, the heating element can be in particular positioned below the evaporator at the bottom side of the evaporator area.

According to one example, the air channel is positioned at a rear side of the refrigeration device and extends from a top side of the refrigeration device to a bottom side of the refrigeration device. As a result, cold air can be efficiently transferred through the air channel into the cooling chamber, without significantly limiting the volume of the cooling chamber.

According to one example, the evaporator area is positioned at a top side of the refrigeration device and extends from a front side of the refrigeration device to a rear side of the refrigeration device. As result, the evaporator area can be efficiently positioned in the refrigeration device and allows for an efficient positioning of the evaporator and fan within the evaporator area.

According to one example, the fan is positioned behind the evaporator in the evaporator area. As a result, during a cooling cycle of the refrigeration device, the fan can efficiently draw in air, which has been cooled by the evaporator before, and can supply the cold air to the cooling chamber.

According to one example, the air channel comprises an air channel wall, wherein a thermal insulator is positioned between the air channel wall and the cooling chamber as well as between the air channel wall and an exterior of the refrigeration device. As a result, due to the thermal insulation, air in the air channel can be efficiently cooled.

According to one example, the fan comprises a recess configured to receive the heat-conducting element. As a result, the heat-conducting element can be at least partly inserted into the surface of the fan, thereby allowing for an efficient heat transfer between heat-conducting element and the fan.

BRIEF DESCRIPTION OF THE SEVERAL VIEWS OF THE DRAWING

Further examples of the principles and techniques of that disclosure are explained in greater detail with reference to the appended drawings, in which.

DETAILED DESCRIPTION OF THE INVENTION

Figure 1:
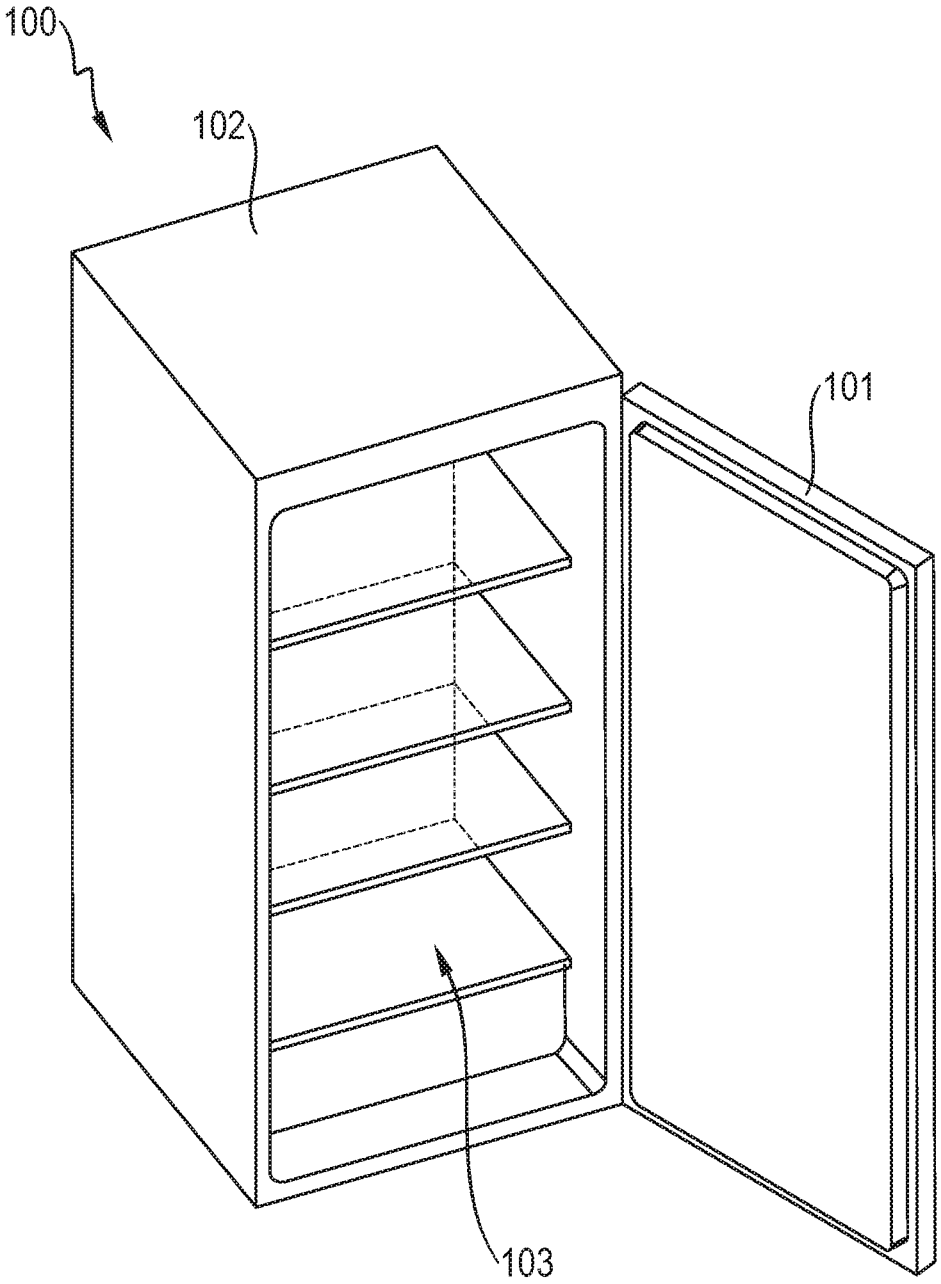
FIG. 1 shows a schematic representation of a refrigeration device.

FIG. 1 shows a schematic representation of a refrigeration device according to the principles described herein.

The refrigeration device 100 comprises a refrigerator door 101 and a refrigerator casing 102, wherein the refrigerator door 101 closes a cooling chamber 103 of the refrigeration device 100.

The refrigeration device 100 comprises one or several refrigerant circuits each comprising an evaporator, compressor, condenser and throttle. The evaporator is a heat exchanger, wherein the liquid refrigerant is vaporized after expanding by heat-uptake from the external medium, e.g. air. The compressor is a mechanically operated device, which pumps refrigerant vapor from the evaporator to the condenser at an increased pressure. The condenser is a heat exchanger wherein after compression the refrigerant vapor is liquidized by transferring heat from the refrigerant to an external medium, e.g. air. The refrigeration device 100 comprises a ventilator to provide an air-flow to the condenser to efficiently cool the condenser. The throttle is a device to reduce the pressure by reducing the diameter within the refrigerant circuit. The refrigerant is a fluid, which takes up heat at low temperatures and low pressure and transfers heat at higher temperatures and higher pressure.

Figure 2:
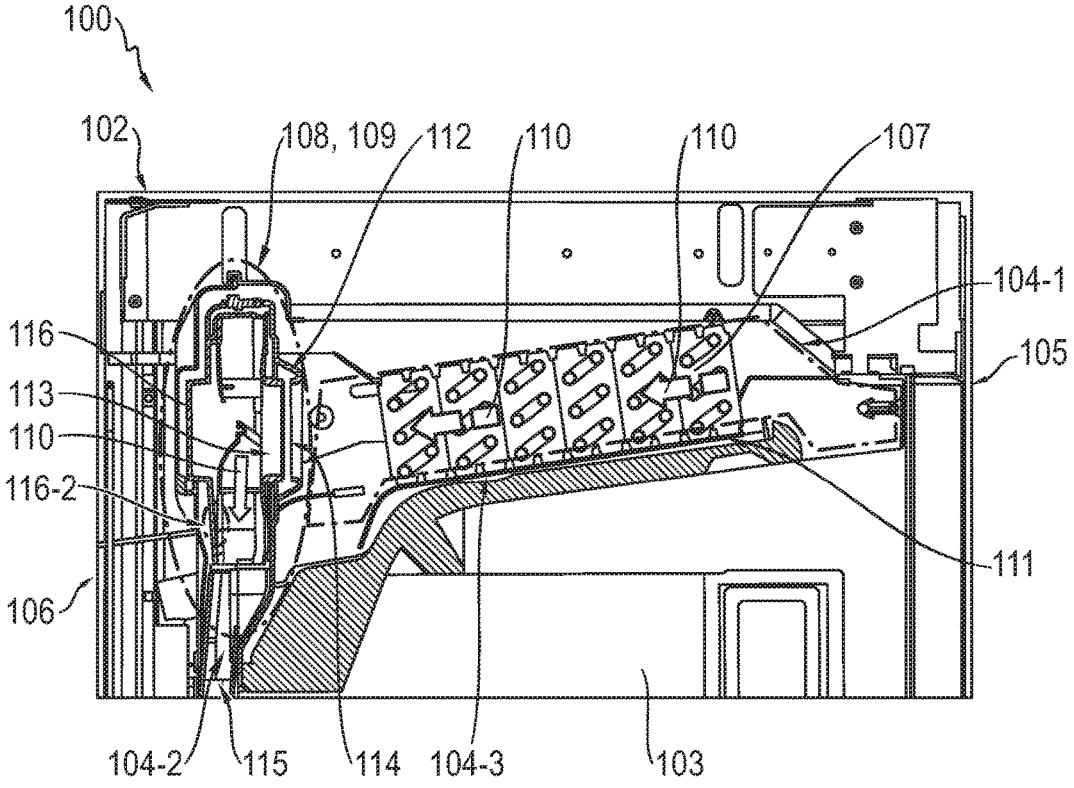
FIG. 2 shows a schematic representation of a fan positioned in an evaporator area of a refrigeration device.

FIG. 2 shows a schematic representation of a fan positioned in an evaporator area of a refrigeration device according to the principles described herein.

A cross-section of the refrigeration device 100 is shown, which comprises a refrigerator casing 102 of the refrigeration device 100. The refrigeration device 100 comprises a cooling chamber 103 capable of storing goods at low temperature, e.g. at a temperature between 4° C. and 8° C.

An evaporator area 104-1 is positioned in the refrigeration device 100 and extends from a front side 105 to a rear side 106 of the refrigeration device 100. An air channel 104-2 is connected to the evaporator area 104-1 and to the cooling chamber 103 to conduct air from the evaporator area 104-1 to the cooling chamber 103.

In the evaporator area 104-1 an evaporator 107 of a refrigerant circuit of the refrigeration device 100 is positioned. The evaporator 107 functions as a heat exchanger, wherein the liquid refrigerant is vaporized after expanding by heat-uptake from air, thereby cooling the air surrounding the evaporator 107.

Further, a fan 108 is positioned in the evaporator area 104-1 behind the evaporator 107. The fan 108 comprises a fan cover 109, which encloses a fan motor housing with a fan motor for powering the fan 108. During a cooling cycle of the refrigeration device 100, the fan 108 draws in air from the evaporator area 104-1, wherein the air passes the evaporator 107 in a direction of flow 110 and is cooled by the evaporator 107. Inside the fan 108, the direction of flow 110 of the cold air is changed and the cooled air is transferred to the air channel 106-2 and further to the cooling chamber 103.

Because of the low surface temperatures of the evaporator 107 and the fan 108, which occur during the cooling cycles of the refrigeration device 100, and because of the humidity present in the air, surface ice can accumulate on the evaporator 107 and on the fan 108, thereby eventually preventing a proper function of the evaporator 107 and the fan 108.

Therefore, to remove the surface ice from the evaporator 107, a heating element 111, which is positioned in the evaporator area 104-1, is activated during a defrost cycle of the refrigeration device 100 to melt the surface ice accumulated on the evaporator 107, thereby generating melt water, which is removed. The heating element 111 comprises a metal sheet, which is positioned at a bottom side 104-3 of the evaporator area 104-1.

During the defrost cycle, the fan 108 is typically turned off. Due to the close proximity of a top surface 112 of the fan 108 and the heating element 111 in the evaporator area 104-1, heated air generated by the heating element 111 is directed to the top surface 112 of the fan 108. The heated air enters a fan inlet 114 of a fan channel 113 and melts surface ice, which is formed in the channel 113, and which is also formed at the top surface 112 of the fan 108. However, when reaching the fan outlet 115, the temperature of the air is not sufficient to properly and completely heat a bottom side 116 of the fan 108. Therefore, a complete removal of ice at the bottom side 116 of the fan 108 is not guaranteed.

In particular, ice can be still present at an ice-depositing area 116-2 close to the bottom side 116.

Consequently, two areas are present in the fan 108, a first area facing towards the evaporator 107, which is positioned at the top surface 112 of the fan 108, and a second area, which is positioned at the bottom side 116 of the fan facing away from the evaporator 107. The first area and the second area of the fan 108 are not depicted in FIG. 2. During the defrost cycle of the refrigeration device 100, the heating element 111 is configured to heat the first area of the fan 108, thereby melting the surface ice accumulated at the first area. However, since the heated air is not sufficiently warm to properly heat the second, more distant, area of the fan 108, a sufficient removal of all surface ice accumulated at the second area of the fan 108 cannot be guaranteed by the heating element 111 itself.

At the bottom side 116 of the fan 108 a heat-conducting element is positioned, which extends from the first area to the second area of the fan 108 and which is configured to transfer heat from the first area to the second area to melt surface ice at the second area of the fan 108, in particular surface ice at the ice-depositing area 106-2. Therefore, by using the heat-conducting element a complete removal of surface ice from both the first and second area of the fan can be accomplished during the defrost cycle.

The heat-conducting element, as well as the first and second area of the fan 108 is not depicted in FIG. 2.

Figure 3:
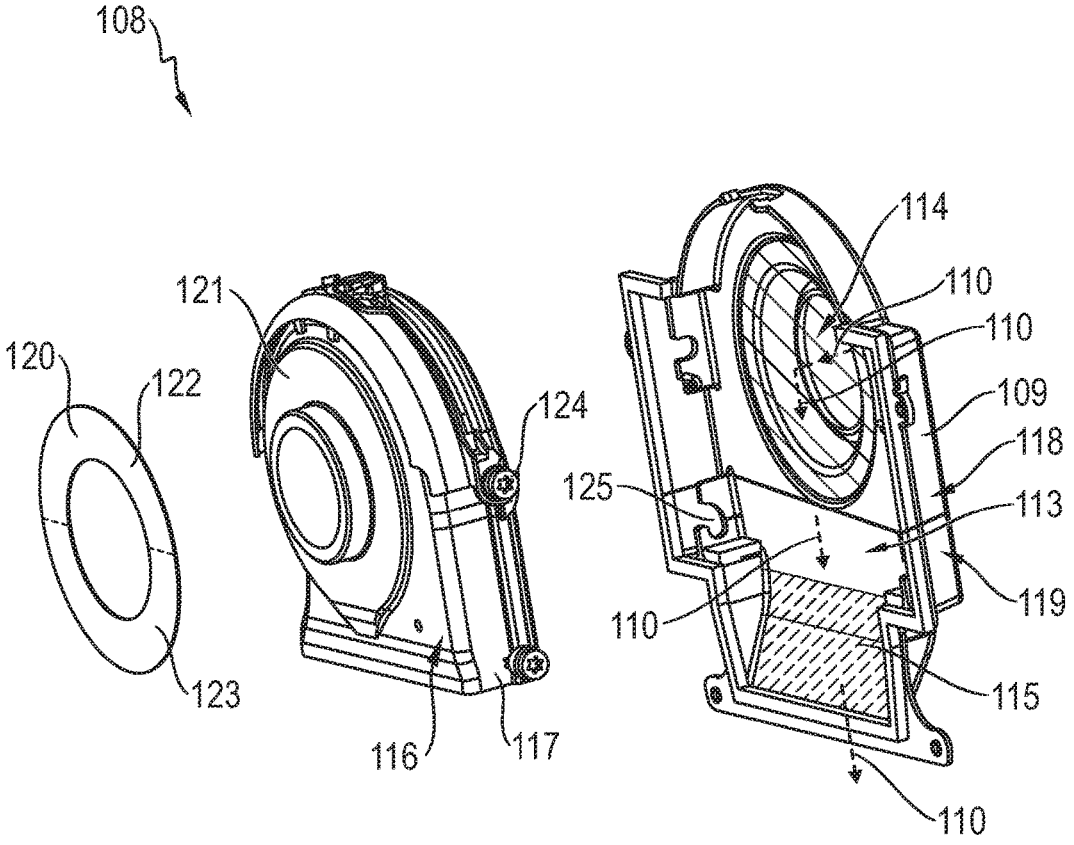
FIG. 3 shows a schematic representation of a fan with a heat-conducting element according.

FIG. 3 shows a schematic representation of a fan with a heat-conducting element in an exploded view.

The fan 108 comprises a fan motor housing 117, which typically comprises metal and/or plastic and is configured to enclose a fan motor to power the fan 108. The fan 108 further comprises a fan cover 109, which typically comprises plastic and is configured to enclose a fan channel 113, which is enclosed by the fan motor housing 117 and the fan cover 109. The channel 113 comprises a fan inlet 114 having an annular inlet opening and comprises a fan outlet 115 having a rectangular outlet opening. Air is introduced into the channel 113 from the fan inlet 114 in a direction of flow 110, wherein the direction of flow 110 of the air is redirected, and wherein the air is transferred through the channel 113 and is released through the fan outlet 115 in a direction of flow 110.

During continuous cooling cycles of the refrigeration device, surface ice accumulates on the surface of the fan 108 and also in the channel 113. Therefore, to enable a sufficient defrosting of the fan 108, a heating element 111 in an evaporator area 104-1, which is not depicted in FIG. 3, is activated. Since the fan inlet 114 is facing towards the heating element 111, while the fan outlet 115 is facing away from the heating element 111, the heat generated by the heating element 111 is sufficient to melt surface ice at the fan inlet 114, but is not sufficient to melt surface ice at the fan outlet 115.

Therefore, the fan 108 comprises a first area 118 facing towards the evaporator 107, which is sufficiently heated by the heating element 111 of the evaporator 107, and comprises a second area 119 facing away from the evaporator 107, which is not sufficiently heated.

To allow for a sufficient heating of the second area 119 of the fan 108, the fan 108 comprises a heat-conducting element 120, which is at least partially inserted into a recess 121 at the bottom side 116 of the fan motor housing 117. The heat-conducting element 120 is formed as a ring, is comprised of aluminum and is in thermally conductive contact with the fan motor housing 117. The heat-conducting element 120 comprises a heat-absorbing area 122, which is in thermally conductive contact with the first area 118 of the fan 108, and comprises a heat-emitting area 123, which is in thermally conductive contact with the second area 119 of the fan 108. Thereby, the heat-conducting element 120 is configured to transfer heat from the first area 118 to the second area 119 of the fan 108 to melt surface ice on the second area 119 during a defrosting cycle of the refrigeration device.

Therefore, even if heated air from the evaporator 107 cannot reach the second area 119 of the fan 108, the heat-conducting element 120 allows for a transfer of heat to the second area 119 by thermal conduction. Therefore, the defrost cycle of the refrigeration device 100 allows for an efficient and complete removal of all surface ice on the evaporator 107 and on the fan 108 without the necessity to add an additional heating source to the fan 108.

Moreover, the fan motor housing 117 comprises connection elements 124, which are received in receiving elements 125 of the fan cover 109, for connecting the fan motor housing 117 with the fan cover 109.

While preferred embodiments of the disclosure have been described herein, many variations are possible which remain within the concept and scope of the invention. Such variations would become clear to one of ordinary skill in the art after inspection of the specification and the drawings. The disclosure therefore is not to be restricted except within the spirit and scope of any appended claims.

The following is a summary list of reference numerals and the corresponding structure used in the above description of the invention:

100 Refrigeration device
101 Refrigerator door
102 Refrigerator casing
103 Cooling chamber
104-1 Evaporator area
104-2 Air channel
104-3 Bottom side of evaporator area
105 Front side
106 Rear side
107 Evaporator
108 Fan
109 Fan cover
110 Direction of flow
111 Heating element
112 Top surface of fan
113 Fan channel
114 Fan inlet
115 Fan outlet
116 Bottom side of fan
116-2 Ice depositing area
117 Fan motor housing
118 First area of fan
119 Second area of fan
120 Heat conducting element
121 Recess
122 Heat-absorbing area
123 Heat-emitting area
124 Connection elements
125 Receiving elements

The invention claimed is:

1. Refrigeration device having a refrigerant circuit for cooling a cooling chamber of the refrigeration device, comprising:

an air channel for conducting air to the cooling chamber;

a fan being positioned in an evaporator area of the refrigeration device, and being configured for supplying air from the evaporator area through the air channel to the cooling chamber in a direction of flow;

an evaporator of the refrigerant circuit being configured for cooling air during a cooling cycle, the evaporator being positioned in the evaporator area in front of the fan in relation to the direction of flow; and a heating element, being positioned in the evaporator area and being configured for heating the evaporator during a defrost cycle for melting surface ice accumulated on the evaporator;

the fan including a first area facing towards the evaporator and a second area facing away from the evaporator, the heating element being configured for heating the evaporator and the first area of the fan during the defrost cycle, and the fan including a heat-conducting element extending from the first area to the second area of the fan, and being configured for transferring heat from the first area to the second area for melting surface ice accumulated on the second area during the defrost cycle;

the fan including a fan cover with a top side facing towards the evaporator, the heat-conducting element being positioned at the top side, and the heat-conducting element being in thermally conductive contact with the first and second area.

2. Refrigeration device having a refrigerant circuit for cooling a cooling chamber of the refrigeration device, comprising:

an air channel for conducting air to the cooling chamber;

a fan being positioned in an evaporator area of the refrigeration device, and being configured for supplying air from the evaporator area through the air channel to the cooling chamber in a direction of flow;

an evaporator of the refrigerant circuit being configured for cooling air during a cooling cycle, the evaporator being positioned in the evaporator area in front of the fan in relation to the direction of flow; and a heating element, being positioned in the evaporator area and being configured for heating the evaporator during a defrost cycle for melting surface ice accumulated on the evaporator;

the fan including a first area facing towards the evaporator and a second area facing away from the evaporator, the heating element being configured for heating the evaporator and the first area of the fan during the defrost cycle, and the fan including a heat-conducting element extending from the first area to the second area of the fan, and being configured for transferring heat from the first area to the second area for melting surface ice accumulated on the second area during the defrost cycle;

the fan having a fan motor housing with a bottom side facing away from the evaporator, the heat-conducting element being positioned at the bottom side, and the heat-conducting element being in thermally conductive contact with the first and second area.

3. Refrigeration device according to claim 2, wherein the heat-conducting element comprises a heat-absorbing area, which is in thermally conductive contact with the first area of the fan, and wherein the heat-conducting element comprises a heat-emitting area, which is in thermally conductive contact with the second area of the fan.

4. Refrigeration device according to claim 2, wherein the fan comprises a fan channel comprising a fan inlet and a fan outlet, wherein air is introduced into the fan inlet, is transferred through the fan channel and is released into the air channel through the fan outlet, wherein the first area of the fan is in thermally conductive contact with the fan inlet.

5. Refrigeration device according to claim 4, wherein the fan comprises a fan motor housing configured to enclose a fan motor, and wherein the fan comprises a fan cover configured to enclose the fan channel, wherein the fan channel is positioned between the fan motor housing and the fan cover.

6. Refrigeration device according to claim 5, wherein the fan inlet comprises an annular inlet opening, or wherein the fan outlet comprises a rectangular outlet opening.

7. Refrigeration device according to claim 2, wherein the heat-conducting element comprises metal, in particular aluminum or steel.

8. Refrigeration device according to claim 2, wherein the heat-conducting element is formed as a ring or as a rectangular sheet.

9. Refrigeration device according to claim 2, wherein the heating element is formed as a metal sheet and is positioned at a bottom side of the evaporator area.

10. Refrigeration device according to claim 2, wherein the air channel is positioned at a rear side of the refrigeration device and extends from a top side of the refrigeration device to a bottom side of the refrigeration device.

11. Refrigeration device according to claim 2, wherein the evaporator area is positioned at a top side of the refrigeration device and extends from a front side of the refrigeration device to a rear side of the refrigeration device.

12. Refrigeration device according to claim 11, wherein the fan is positioned behind the evaporator in the evaporator area.

13. Refrigeration device according to claim 2, the air channel comprises an air channel wall, wherein a thermal insulator is positioned between the air channel wall and the cooling chamber as well as between the air channel wall and an exterior of the refrigeration device.

14. Refrigeration device according to claim 2, wherein the fan comprises a recess configured to receive the heat-conducting element.

* * * * *